US006407706B2

(12) United States Patent
Vernon

(10) Patent No.: US 6,407,706 B2
(45) Date of Patent: Jun. 18, 2002

(54) PLANAR ANTENNA DEVICE

(76) Inventor: Peter J. Vernon, 10 Camira St., Maroubra (AU), NSW 2035

( * ) Notice: Subject to any disclaimer, the term of this patent is extended or adjusted under 35 U.S.C. 154(b) by 0 days.

(21) Appl. No.: 09/888,768

(22) Filed: Jun. 25, 2001

Related U.S. Application Data

(63) Continuation-in-part of application No. 09/098,771, filed on Jun. 17, 1998, now Pat. No. 6,252,550.

(51) Int. Cl.[7] ..... H01Q 1/38; H01Q 11/12

(52) U.S. Cl. ..... 343/700 MS; 343/713; 343/742; 343/867

(58) Field of Search ..... 343/700 MS, 702, 343/713, 741, 742, 866, 867; 29/600

(56) References Cited

U.S. PATENT DOCUMENTS

| | | | | |
|---|---|---|---|---|
| 2,082,812 A | | 6/1937 | Worrall | 343/867 |
| 3,390,394 A | | 6/1968 | Glimvall | 343/742 |
| 5,198,826 A | | 3/1993 | Ito | 343/726 |
| 5,363,114 A | | 11/1994 | Shoemaker | 343/828 |
| 5,442,368 A | | 8/1995 | Harada et al. | 343/713 |
| 5,714,965 A | | 2/1998 | Taguchi | 343/866 |
| 5,757,328 A | | 5/1998 | Saitoh | 343/742 |
| 5,973,650 A | | 10/1999 | Nakanishi | 343/742 |
| 6,252,550 B1 | * | 6/2001 | Vernon | 343/700 MS |

* cited by examiner

*Primary Examiner*—Tan Ho
(74) *Attorney, Agent, or Firm*—Akerman Senterfitt

(57) ABSTRACT

A planar antenna including a rectangular conductive element formed from two square elements. The square elements are defined within the rectangle by a centrally located and bifurcated return conductor having two legs. Each square element is connected at one end to a connector element and at the other end to the return conductor. The dimensions of the square elements are chosen so as to maximize gain for selected radio frequencies. The antenna further includes one or more additional but partial square elements, each additional partial square element terminating adjacent the respective square element at one end and being defined by one leg of the return conductor on one side.

9 Claims, 3 Drawing Sheets

PLANAR ANTENNA DEVICE

The present application is a continuation-in-part application of my U.S. application Ser. No. 09/098,771 filing date Jun. 17, 1998 now U.S. Pat. No. 6,252,550.

TECHNICAL FIELD

The present invention relates to antennas intended to be affixed to surfaces, for use with radio frequency devices such a cellular phones, GPS location systems, and other RF applications. The present invention further relates to a method for manufacturing conductive patterns on substrates.

BACKGROUND ART

Many applications currently exist where an RF antenna is provided in order to enable communication—for example, cellular telephones, GPS systems, wireless data networks and the like. In some cases the antenna is provided with the device, for example as a stub unit on a cellular phone. In other cases, however, it is necessary to provide an externally connected antenna. Further, in applications such as in-car use of cellular phones, it is desirable to provide an additional antenna to boost signal strength. Traditional antennas for this purpose have been generally externally mounted on the vehicle. This increases wind noise, is prone to vandalism, and detracts from the appearance of the vehicle.

For any antenna application of this type, various issues need to be considered. Apart from addressing the problems mentioned above, the antenna should provide maximum capture area, whilst ideally being visually unobtrusive. It should be simple to install, yet electrically and structurally reliable.

It has been proposed to provide an antenna by adhering an array to the inside of a window of a motor vehicle. U.S. Pat. No. 5,363,114 to Shoemaker describes a planar, serpentine antenna which is adhered to a carrier layer, and which is then adhered to a suitable vehicle surface. The antenna is disclosed as having a serpentine patterned arrangement.

It is an object of the present invention to provide an improved antenna for mounting on planar surfaces.

SUMMARY OF INVENTION

According to one aspect the present invention provides a planar antenna comprising a rectangular conductive element formed from two square elements, the square elements being defined within the rectangle by a centrally located and bifurcated return conductor having two legs, each square element being connected at one end to a connector element and at the other end to said return conductor, wherein the dimensions of the square elements are chosen so as to maximize gain for selected radio frequencies, characterised in that the antenna further includes one or more additional but partial square elements, each additional partial square element terminating adjacent the respective square element at one end and being defined by one leg of the return conductor on one side.

It will be understood that the term planar is intended to mean both flat surfaces and smooth curved surfaces, such as for example the shape of a vehicle windshield.

The inventive antenna arrangement has a number of advantages over the existing designs. The intended applications, where the antenna is adhered to an existing surface such as a window, do not require that the conductive elements be structurally rigid themselves, thereby enabling the use of a sparse geometry. This also enables the antenna to have a relatively large capture area, as it is mounted on a surface and not freestanding. Further, as there are elements disposed both horizontally and vertically, the antenna can receive either vertically or horizontally polarised signals well, which is advantageous in applications where scattering due to buildings and other structures occurs.

The present invention also provides a method for providing conductive elements on a substrate, including the steps of:

printing a desired conductor pattern onto a substrate, using conductive ink; and electrodepositing further conductive material onto the conductor pattern, using the pattern formed from conductive ink as an electrode in an electroplating process.

The conductive material may be conveniently copper. The parameters of the electroplating process will depend upon the process selected, but should be such as to provide an adequate thickness of copper, but not so much that too much copper is deposited and the pattern becomes vulnerable to mechanical failure. The inventor has found that in the cellular phone application a thickness of about 25 microns is suitable.

The pattern is suitably printed using a screen printing process. In practice, a large sheet of flexible material can be printed and cut using a suitable tool to provide many antenna arrays.

After depositing, preferably a double sided adhesive film, preferably transparent, is applied both to provide a mechanism for adhesion to the desired surface, and to inhibit corrosion of the copper.

The inventors have investigated various methods for practical manufacture of the antenna. Whilst the invention arose in this context, it will be understood that the inventive method can equally be applied to manufacture of other conductor on substrate devices. The use of conductive ink alone did not provide suitable resistive properties for the antenna, and the addition of electrodeposition to the printing approach was only arrived at after significant trial and error.

BRIEF DESCRIPTION OF DRAWINGS

An embodiment of the present invention will now be described with reference to the accompanying drawings, in which.

DETAILED DESCRIPTION

The present invention is principally described in terms of a device designed to be adhered to a surface as an add-on device. However, it will be appreciated that the inventive antenna design could be formed as part of an article or within, for example, part of a vehicle or a casing for an electronic device.

Figure 1:
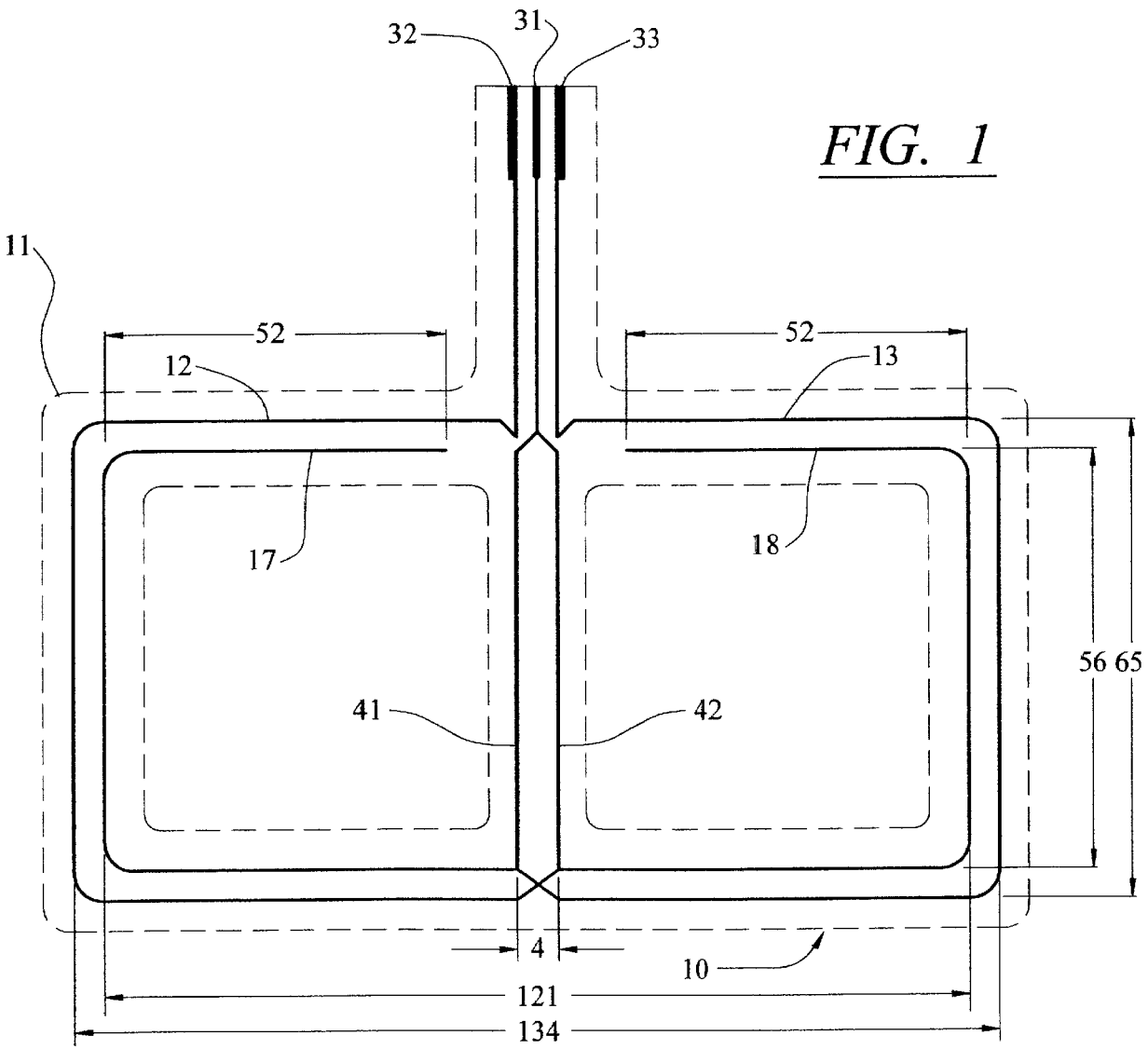
FIG. 1 is a plan view of one embodiment of the inventive device.

FIG. 1 shows an embodiment of the present invention suitable for use as a multi-band antenna on the bands for cellular telephone frequencies, Global Positioning Satellite (GPS) frequencies and Personal Communication System (PCS) frequencies.

Antenna 10 is generally rectangular in shape, and is formed with four elements 12, 13, 17 and 18. The two elements 12 and 13 are square elements which are connected to the connector elements 32 and 33 respectively. Adjacent sides of the elements 12 and 13 are formed by the legs 41 and 42 of a common return element which is also connected to the connector element 31. The two elements 17 and 18 are partial square element and are provided respectively inside elements 12, 13. However, instead of being connected to the connector elements 32 and 33 (as are the square elements 12 and 13) the partial square elements 17 and 18 stop short of legs 41, 42 respectively. The bifurcated element with legs 41 and 42 forms the common side of the square (or partial square) formed by each of elements 12, 13, 17 and 18, and is connected to the centre connector 31.

This design is based upon a recognition that for many applications reception on multiple bands is useful, and also that multiple harmonics of the 900 MHz band fall close to other bands, in this case the GPS band at 1575 Mhz, and PCS band at 1800–2000 Mhz. The elements 12 and 13 have dimensions suitable for 900 MHz+/−50 MHz. The central elements 17 and 18 allow for proper resonance on the GPS and PCS bands.

The antenna dimensions are shown on the figure. The tracks are desirably about 1 mm across and about 30 microns thick, including both the conductive ink and the copper. Although the corners are shown as right angles, the corners may be rounded if desired. The antenna elements are mounted on a sheet 11, shown in dotted outline, of suitable flexible material. This may be any suitable substrate, for example clear polyester, or any material used for flexible PCBs. It is preferred that the material be transparent, particularly for in-vehicle use, so as to minimise the obstruction to vision. In the applications discussed, the film is suitably between 75 and 300 microns thick.

The appropriate length for the elements of the antenna can be determined from the formula:

$$L=K/F$$

where L is the length, F is the frequency, and K is a constant which varies with the dielectric properties of the material surrounding the conductor. In the case of the implementation described, the dielectric properties of the substrate need to be considered. It will be appreciated that in use the dielectric properties of the surface adhered to, for example the windshield glass, will also be relevant to the constant K and consequently to the length L.

For the antenna with the dimensions as illustrated in FIG. 1, the resonant frequencies on a glass substrate are 99 MHz and 1800 MHz, and the antenna has a VSWR of 1.08:1 on the 900 MHz band and 2.8:1 on the 1575 MHz band.

Figure 3:
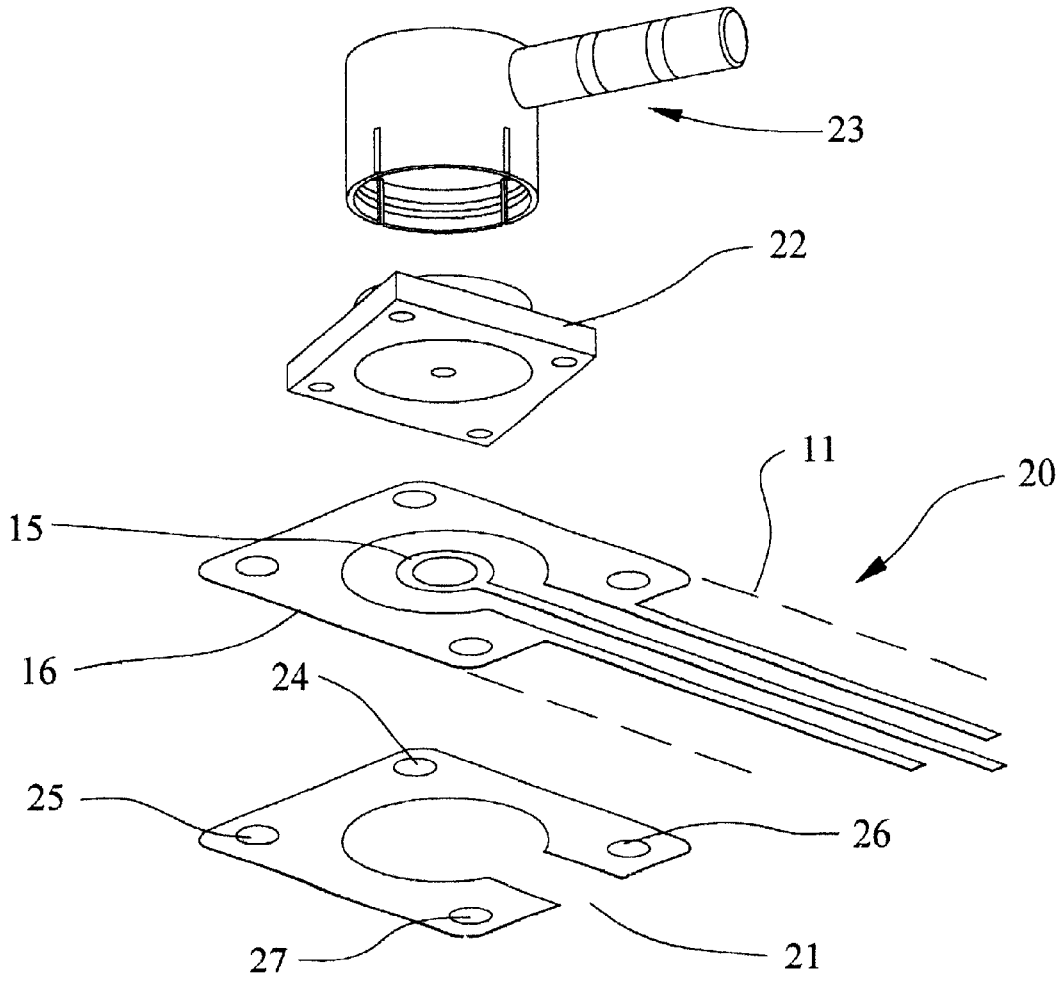
FIG. 3 is an exploded view of the connector arrangement of FIG. 2.

The clear film used in the preferred implementation cannot tolerate the high temperatures involved with, for example, soldering. FIG. 3 shows in exploded view an arrangement developed by the inventor to enable connection of the antenna to a transmission line.

Figure 2:
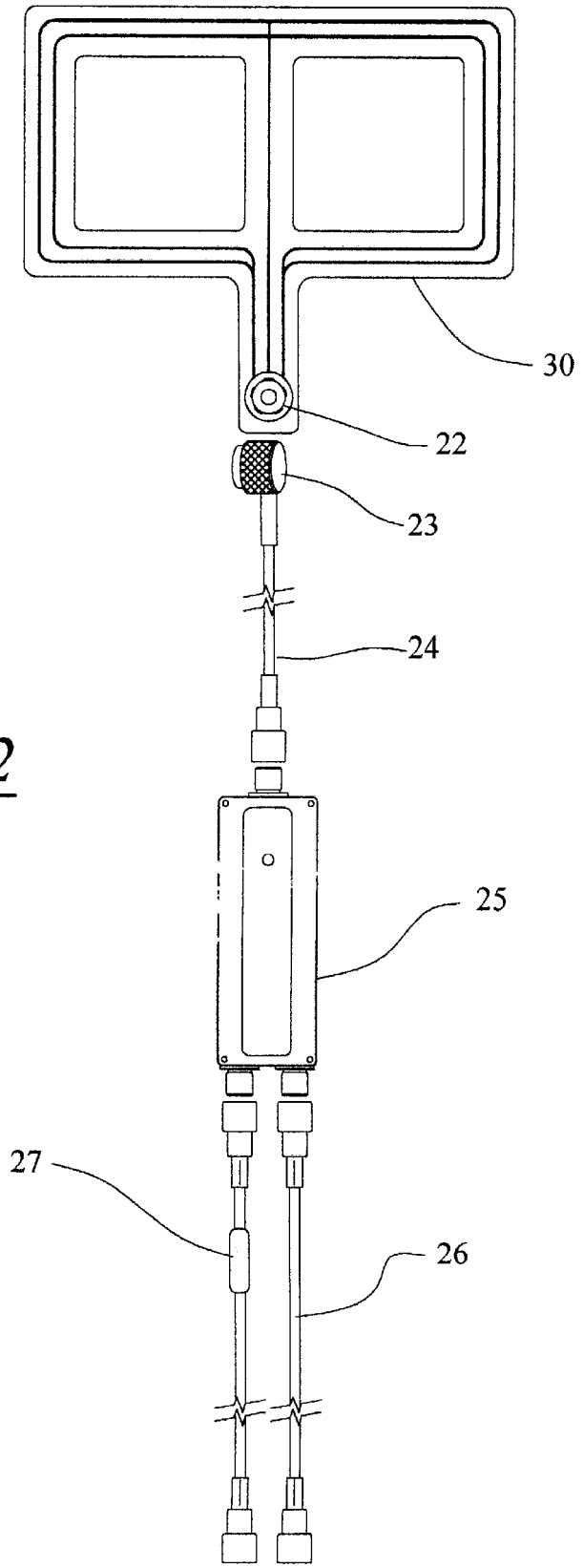
FIG. 2 is a schematic illustration showing connection of another embodiment of the invention to enable multiple device connection.

In the embodiment of FIGS. 2 and 3, element 20 is the connection part of the copper track. It will be appreciated that this is held between the substrate film 11, and the double sided adhesive film (not shown) and so the contacts are not exposed for simple connection. Shim 21 is placed below element 20, and socket 22 above element 20. Conductive rivets, for example of brass, are inserted through the openings 24,25,26,27 in the shim, through element 20, and through the corresponding holes in socket 22. This provides an electrical connection between the body of socket 22 and the outer part 16 of element 20. A further rivet passes through the central part 15 of element 20 and into the central part of socket 22. Plug 23 can then be readily connected, illustratively by a force-fit mechanical connection, so as to provide a cable link to the device for connection to the antenna.

FIG. 2 illustrates a connection arrangement for a device according to the present invention—where multiple bands are received, and it is desired to connect these to separate devices. Illustratively, these are a cellular phone and a GPS receiver. Antenna 30 is connected via socket 22 to plug 23 on cable 24. Cable 24 connects the antenna to antenna power splitter unit 25. This then provides a connection 26 for a cellular phone, and a connection 27 for a GPS receiver.

Devices suitable for use as the antenna power splitter 25 are commercially available. The function of this device is to isolate the output ports 26, 27 from each other so that the respective devices do not interfere with each other. In this specific context, the concern would be to ensure that the cellular phone's transmit energy does find its way to the GPS receiver. It is desirable that the antenna power splitter would have an isolation factor of at least −25 dB in this application. It will be appreciated that the necessary isolation will depend on the devices intended to be connected to the antenna 30.

It will be understood that while the present invention is described mostly in the context of an in-vehicle antenna adhered inside a window, many other applications exist. The inventive antenna could be adhered to an internal or external building wall, or used to implement a wireless LAN or other data network. It could be readily used, with modifications to suit band changes, for mobile or fixed data logging and transfer.

The inventive method could be applied wherever a highly conductive pattern is required, particularly where a transparent substrate is used.

What is claimed is:

1. A planar antenna including a rectangular conductive element formed from two square elements, the square elements being defined within the rectangle by a centrally located and bifurcated return conductor having two legs, each square element being connected at one end to a connector element and at the other end to said return conductor, wherein the dimensions of the square elements are chosen so as to maximize gain for selected radio frequencies, characterised in that the antenna further includes one or more additional but partial square elements, each additional partial square element terminating adjacent the respective square element at one end and being defined by one leg of the return conductor on one side.

2. An antenna according to claim 1, wherein the conductive elements are formed on a substrate.

3. An antenna according to claim 2, wherein the substrate is a flexible film.

4. An antenna according to claim 2 or claim 3, wherein the substrate is transparent.

5. An antenna according to claim 2, wherein the conductive elements have been provided by a method that includes the steps of:

printing a conductor pattern onto the substrate using conductive ink; and electrodepositing further conductive material onto the printed conductor pattern, using the pattern formed from conductive ink as an electrode in an electroplating process.

6. An antenna according to claim 5, wherein the conductor pattern is screen printed onto said substrate.

7. An antenna according to claim 6, wherein a plurality of conductor patterns are printed onto said substrate, and after electrodeposition a protective film is applied to the conductor pattern.

8. An antenna according to claim 7, wherein the film is adhesive on both sides.

9. An antenna according to claim 1, wherein all the square elements are electrically connected to the same connector element, and the return conductor is connected to an electrically separate connector element.

* * * * *